US006094192A

United States Patent [19]

Kobayashi et al.

[11] Patent Number: 6,094,192

[45] Date of Patent: Jul. 25, 2000

[54] COMMON ELECTRODE DRIVING DEVICE IN A LIQUID CRYSTAL DISPLAY

[75] Inventors: Yoshinao Kobayashi, Hiratsuka; Akihiro Kuroda, Yokohama; Kazuo Sekiya, Tokyo, all of Japan

[73] Assignee: International Business Machines Corporation, Armonk, N.Y.

[21] Appl. No.: 08/952,625

[22] PCT Filed: May 23, 1995

[86] PCT No.: PCT/JP95/00991

§ 371 Date: Nov. 20, 1997

§ 102(e) Date: Nov. 20, 1997

[87] PCT Pub. No.: WO96/37803

PCT Pub. Date: Nov. 28, 1996

[51] Int. Cl.[7] ..... G09G 5/00

[52] U.S. Cl. ..... 345/210; 345/211; 345/212; 345/214

[58] Field of Search ..... 345/84, 85, 87, 345/104, 204, 208, 210, 211, 212, 213, 214

[56] References Cited

U.S. PATENT DOCUMENTS

| | | | |
|---|---|---|---|
| 4,070,663 | 1/1978 | Kanatani et al. | 340/324 |
| 5,481,273 | 1/1996 | Shigeta et al. | 345/94 |
| 5,627,557 | 5/1997 | Yamaguchi et al. | 345/90 |
| 5,786,794 | 7/1998 | Kishi et al. | 345/60 |

FOREIGN PATENT DOCUMENTS

| | | |
|---|---|---|
| 3-259218 | 11/1991 | Japan . |
| 5-265406 | 10/1993 | Japan . |

*Primary Examiner*—Vijay Shankar
*Attorney, Agent, or Firm*—J. P. Sbrollini

[57] ABSTRACT

A driver for driving a common electrode of a liquid crystal display panel comprises a first driver for driving the common electrode to hold a predetermined voltage every horizontal scan period, a charge hold capacitance having a capacity bigger than a capacity of the common electrode as a capacitance, an inductance for forming with the charge hold capacitance a resonance circuit, switch means for switching on the resonance circuit for a predetermined period when the voltage of the common electrode is changed, and a second driver for replacing last charge back into the charge hold capacitance. The driving by the first driver is reduced because of the charge hold capacitance. The second driver puts surplus charge into the charge hold capacitance so that the voltage of the common electrode can be rapidly charged to a desired voltage.

9 Claims, 4 Drawing Sheets

FIG. 3
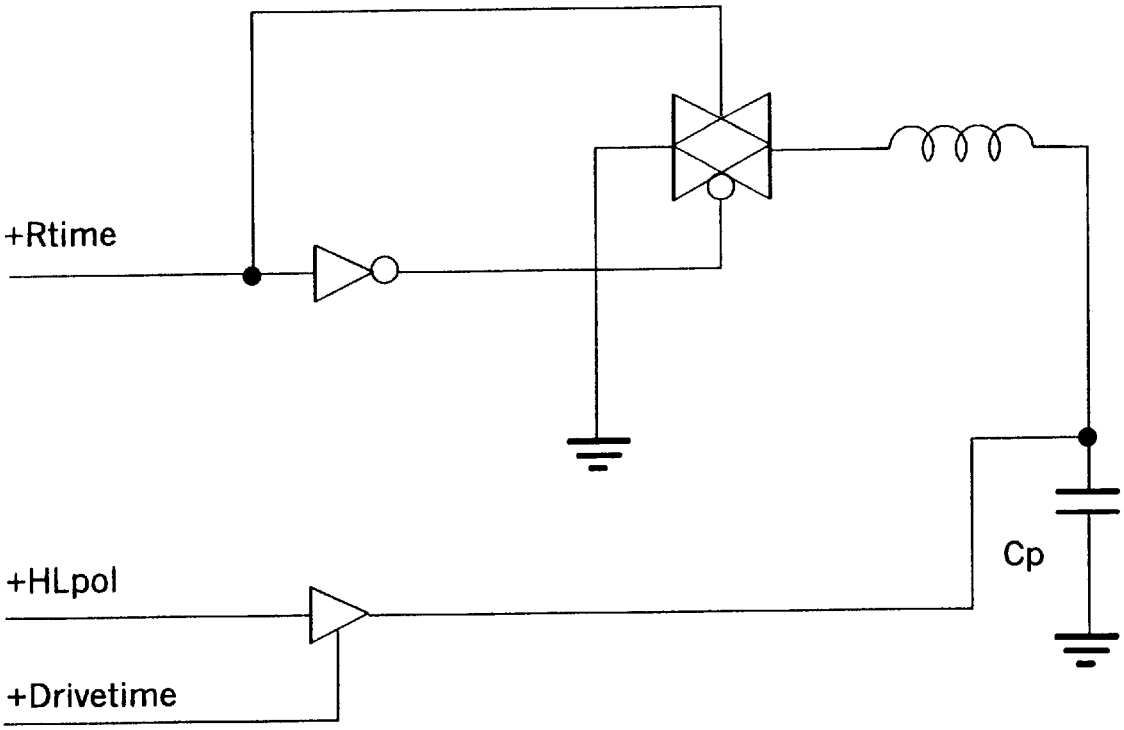
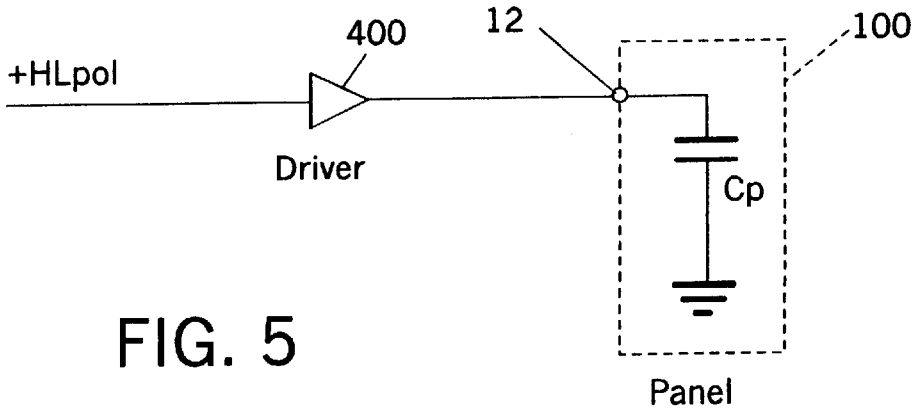
FIG. 5

COMMON ELECTRODE DRIVING DEVICE IN A LIQUID CRYSTAL DISPLAY

FIELD OF THE INVENTION

The present invention relates to a liquid crystal display (LCD) panel, and, more particularly, to a device performing common inversion in the LCD panel.

DESCRIPTION OF THE BACKGROUND ART

Typically, when a TFT LCD panel (TFT LCD panel is an LCD panel used in an in active matrix array) is driven, it is necessary to apply voltages with different polarities to the liquid crystal used in the LCD at predetermined durations because it may be damaged if voltage with the same polarity is continuously applied. For example, this is not a problem if a driver circuit driving the LCD panel can output signals in a range from +5V to −5V. However, the problem occurs in a case where the TFT LCD panel is driven by using a source driver which can output only up to 5V in one polarity. In such a case, the above-mentioned alternating current driving has been apparently performed by swinging the driving voltage for common electrode in a range between 0V and about 5V (sometimes, −1V and +6V). The common electrode is a capacitive load which requires relatively high power of as much as 0.5 W for charge and discharge for VGA (640×480 pixels).

FIGS. 4 and 5 show an example of the background art. FIG. 4 shows a TFT LCD panel 100. The LCD panel 100 comprises a column driver 200 for distributing a video signal to each source line 102, a row driver 300 driving each gate line 104, transistors 106 the source of which is connected to the source line 102, the gate of which is connected to the gate line 104, and which exist in the number of pixels, liquid crystal (illustrated as capacitors 108), and a common electrode 12 mounted on a surface opposite to the transistors 106. Because this TFT LCD panel 100 is of a conventional type, further description is not given. When the column driver 200 outputs a signal on the source line 102, a transistor 106, which is connected to a gate line turned on by the row driver 300, drives the liquid crystal 108 with the voltage output on the source line 102 so as to display a desired image.

Here, if the column driver 200 driving the source line can output a signal only 5V in one polarity as mentioned earlier, the voltage for the common electrode 12 must be swung between 0V and about 5V. Since the circuit at and after the liquid crystal 108 as viewed from the common electrode 12 is a capacitive load as described earlier, it appears to be a capacitance $C_P$ (about 0.2 $\mu$F) as shown in FIG. 5. This capacitance has been driven by a driver 400.

Such drive method for the common electrode 12 needs much power. When such LCD panel is used for a notebook computer, power saving is one of major problems. Reducing power consumed by the LCD panel leads to extension of available time of the entire computer.

Another example of the background art is found in PUPA 5-265406 which discloses a device in which containing multiple electrodes, one common electrode is short circuited to another one in common inversion to transfer charges stored in one common electrode to the other, and, then, a driver circuit drives it to desired potential. However, this approach requires a special common electrode. In addition, short-circuiting only makes the potential in two common electrodes equivalent, and driving by the drive circuit is required for making the common electrode the desired voltage so that reduction of power consumption would be small.

SUMMARY OF THE INVENTION

An object of the present invention is to provide a device which changes the voltage for the common electrode of an LCD panel to a desired voltage less drive current electrode.

More particularly, the object of the present invention is to provide a device which consumes less power by recovering and reusing energy stored in the common electrode.

Another object of the invention is to provide a circuit which attains saving of power consumption with less noise.

The device to attain the objects just described is a driver for a common electrode comprising: a first driver for driving a common electrode of a liquid crystal display panel to hold a predetermined voltage every horizontal scan period, a charge hold capacitance having a capacity bigger than a capacity of the common electrode as a capacitance, an inductance for constructing a resonance circuit, switch means for switching to operate the resonance circuit for a predetermined period when the voltage of the common electrode is changed, and a second driver for compensating for insufficient charge in the charge hold capacitance. With such arrangement, the charge hold capacitance retains charge stored in the common electrode so that driving by the first driver is reduced. The second driver compensates for loss in the circuit resulting in placing insufficient charge into the charge hold capacitance so that the voltage of the common electrode can be quickly changed to a desired voltage.

Another aspect of the present invention is a driver for a common electrode comprising: a driver for driving the common electrode to hold a predetermined voltage every horizontal scan period, a charge hold capacitance, an inductance in a resonance circuit, and switch means for switching to operate the resonance circuit for a predetermined period when the voltage of the common electrode is changed. In this case, because the second driver does not supply insufficient charges, the driving by the driver is not reduced as much as in the previous aspect of the present invention due to loss in the circuit. However, power is sufficiently saved than in the background art.

In the above two aspects, it is possible to connect one end of the inductance to the common electrode and the other end to the switch means, and to connect one end of the inductance to the charge hold capacitance and the other end to the switch means.

In addition, in the first aspect of the present invention, the second driver may be arranged to operate while the first driver is operating.

In the first and second aspects of the present invention, the duration in which the resonance circuit operates is set to half of the cycle of the resonance circuit. This causes all charge stored in one capacitance to move to the other so that the maximum performance can be attained.

Still another aspect of the present invention is a driver for a common electrode comprising: a driver for driving the common electrode to hold two predetermined voltages symmetrical to the ground voltage every horizontal scan period, an inductance in a resonance circuit, and switch means for switching on the resonance circuit for a predetermined period when the voltage of the common electrode is changed, wherein the inductance or the switch means are connected to the ground. This causes the resonance circuit to move energy so that the common inversion can be performed with less energy than full driving by the driver.

In this case, the maximum performance can be attained by turning off the switch means at the time when the current flowing through the inductance becomes substantially zero.

The above-mentioned driver for the common electrode is of course implemented in a liquid crystal display panel.

According to the first aspect of the present invention, when the voltage of the common electrode is changed, the switch means turns on the switch to operate the resonance circuit for a predetermined period, and moves the energy in the common electrode to the charge hold capacitance. Then, when the switch means turns off the switch, the first driver drives the common electrode to hold a predetermined voltage. At the moment, the second driver adds charge to compensate for insufficient charge in the charge hold capacitance for the next inversion. During the next horizontal scan period, the switch means is turned on for a predetermined period to drive the common electrode with the energy held in the charge capacitance. After the switch means turns off the switch, the first driver operates so that the common electrode holds the predetermined voltage. The same true for the second driver.

The second aspect of the present invention operates in the same manner as the first aspect, except for that the second aspect does not have the second driver.

According to the third aspect of the present invention, when the voltage of the common electrode is changed, the switch means turns on the switch to operate the resonance circuit for a predetermined period, and moves the energy in the common electrode to the ground which is a sort of large capacitance. Then, when the switch means turns off the switch, the driver drives the common electrode to hold the predetermined voltages. During the next horizontal scan period, the switch means is turned on for a predetermined period to drive the common electrode with the energy from the ground. After the switch means turns off the switch, the driver operates to hold the predetermined voltage.

BRIEF DESCRIPTION OF THE DRAWINGS

FIG. 3 is a diagram showing a second embodiment of the present invention;

FIG. 5 is a diagram for illustrating a background art.

PREFERRED EMBODIMENT OF THE INVENTION

Figure 1:
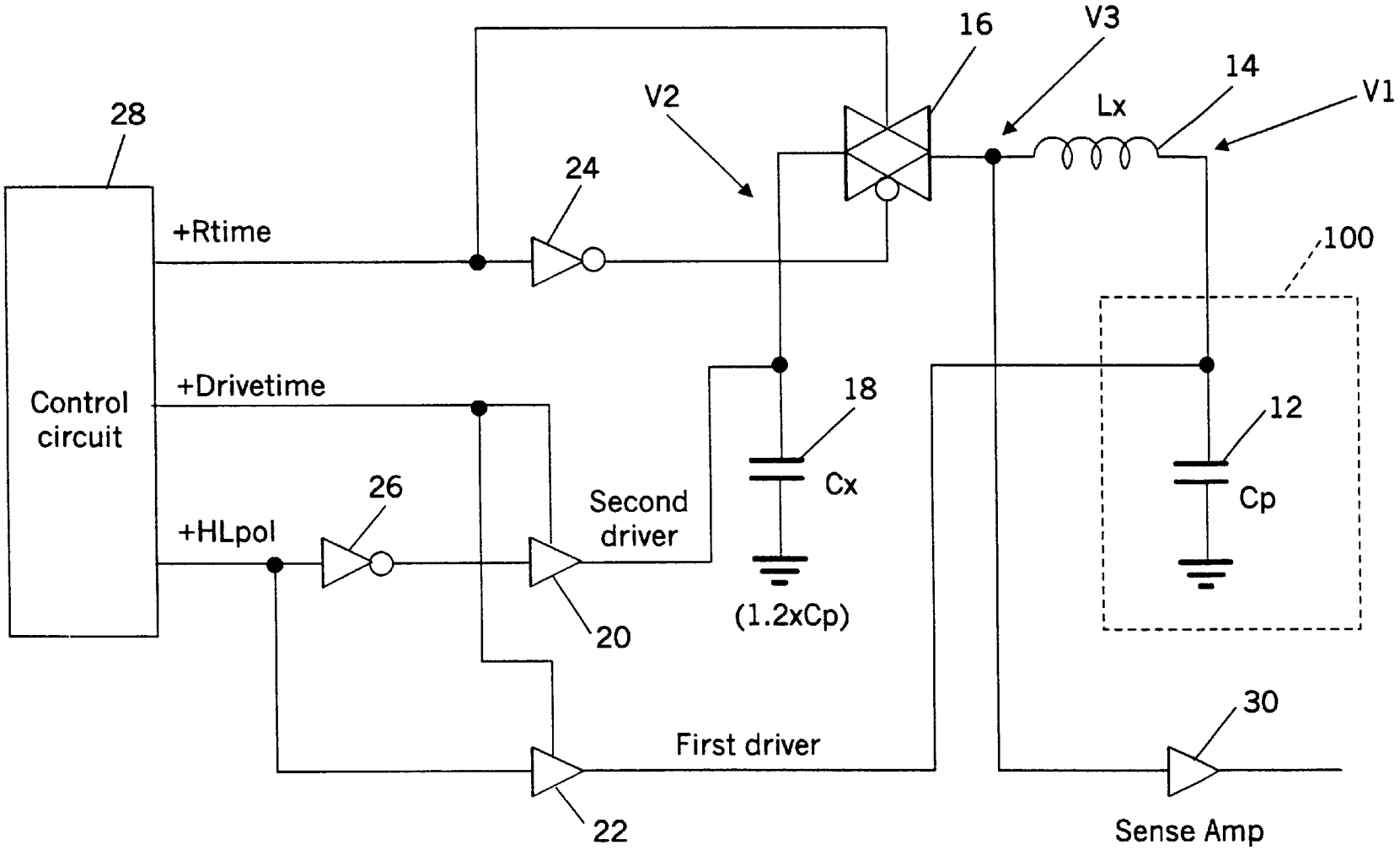
FIG. 1 is a schematic diagram showing an embodiment of the present invention.
Figure 4:
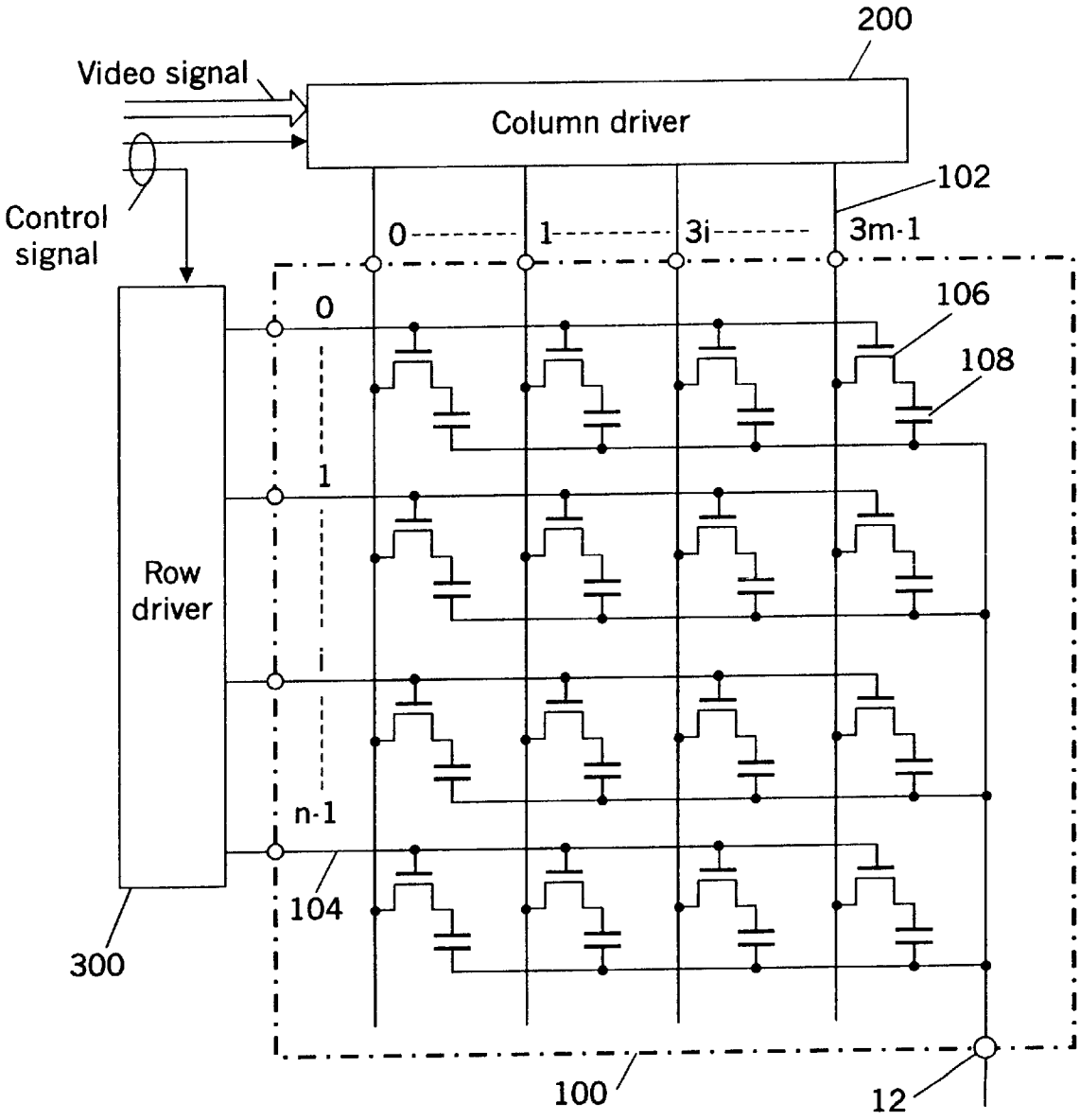
FIG. 4 is a diagram for illustrating a liquid crystal display panel.

FIG. 1 shows the arrangement of the present invention. Here, the LCD panel 100 is the same as that shown in FIG. 4. It is assumed that the LCD panel 100 has capacity $C_P$ as its capacitance is in FIG. 4. A common electrode 12 is also same as that in FIG. 4. The common electrode 12 is connected with an inductance 14 and a first driver 22. The inductance 14 is connected with a capacitance 18 and a second driver 20 through an analog switch 16. It is a control circuit 28 that supplies a signal (+Rtime) to operate the analog switch 16. Because it requires an inversion signal, an invertor 24 is provided. Also, a signal (+Drivetime) for operating the first and second drivers is outputted from the control circuit 28. The first and second drivers drive the capacitance ($C_P$) of the LCD panel 100 and the capacitance 18 respectively. Signals for driving them are also supplied from the control circuit 28. Because of the polarity difference between a signal driver by the first driver 20 and a signal driver by the second driver 22, an invertor 26 is provided.

As described in the description of the background art, the voltage of the common electrode 12 must be changed every horizontal scan period depending on the capability of the first driver 22. A resonance circuit is used for the voltage change in every horizontal scan period. That is, because the common electrode 12 of the LCD panel 100 can be considered as the capacitance $C_P$, it constitutes a serial resonance circuit with the inductance 14 connected thereto. It is sufficient to establish the size $L_X$ of the inductance 14 to make the resonant frequency of the resonant circuit about 2 to 5 times the horizontal scanning frequency when taking into account the fact that the column driver 200 (FIG. 4) outputs a desired voltage after the potential of the common electrode 12 is stabilized. The resonance frequency is about 100 Khz for a VGA liquid crystal display panel. In addition, the newly provided capacitance 18 is for holding the energy taken out from the capacitance $C_P$ with the resonance circuit. Its capacity $C_X$ is set at a value larger than the capacity $C_P$ of the LCD panel 100. Because the LCD panel 100 does not consist of only the capacitance $C_P$ and the inductance 14 does not consist of only the inductance component some loss occurs in the circuit. If the capacity $C_X$ of the capacitance 18 is equal to or less than the capacity $C_P$ of the LCD panel 100, the capacitance $C_P$ cannot be fully driven because of such loss. However, if there were no such loss, making $C_X=C_P$ would cause no problem. $C_X$ is suitably to be about 1.0 to 1.5 times $C_P$, and about 2 times at the maximum.

Now, the operation of the circuit shown in FIG. 1 is described. In operation, the analog switch 16 opens to start the operation of the resonance circuit. When half of the cycle of the resonance circuit passes, the analog switch 16 is closed to stop the operation of the resonance circuit. Then, the potential at $C_P$ is inverted (the potential change to the other). Then, the first driver 22 is activated to fix the potential of $C_P$. In this state, the capacitance 18 recovers the energy of $C_P$. However, as there is loss in the circuit, as described earlier, all energy is not recovered. Thus, the second driver 20 is activated to make up for the loss in the circuit and the loss caused by the circuit at the common inversion. Such supply of surplus energy enables it to quickly change $C_P$ to a desired potential, and to reduce driving by the first driver 22.

Then, when the common inversion is performed again, the analog switch 16 is opened to start the operation of the resonance circuit. With the operation of the resonance circuit, the potential of $C_P$ is inverted by the energy stored in the capacitance 18. As is in the above, the analog switch 16 is closed when half of the resonance cycle passes. Then, the first driver 22 is activated to fix the potential of $C_P$. The same procedure applies thereafter.

Figures 2A, 2B, 2C, 2D, 2E, 2F:
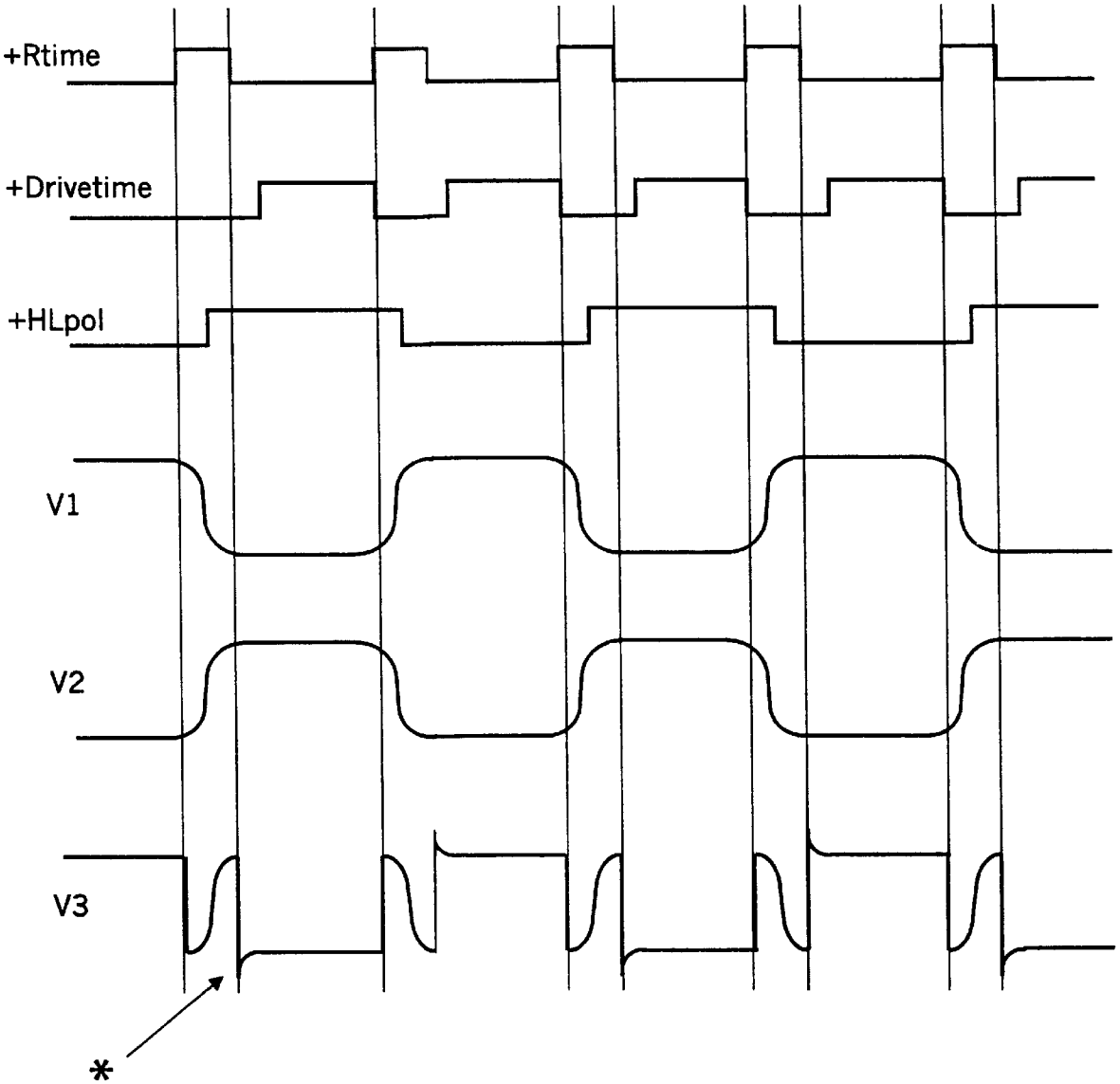
FIG. 2 is waveforms at predetermined sections in the circuit shown in FIG. 1.

FIGS. 2 (*a*)–(*c*) shows waveforms of +Rtime, +Drivetime, and +HLpol signals, respectively. A half cycle of the +Hlpol signal (FIG. 2 (*c*)) is the horizontal scan period. As shown, +Rtime operates the resonance circuit, and then +Drivetime operates the first and second drivers. Such a supply of those signals causes $V_1$ and $V_2$ in FIG. 1 to show the potential waveforms as indicated by FIGS. 2 (*d*) and (*e*).

Opening and closing of the analog switch 16 are controlled by the signal +Rtime, the timing of which is determined by using a following responsive to the a sense amplifier 30 in FIG. 1. At the moment when the analog switch 16 is turned off, counter electromotive force is generated across the coil. This voltage changes to negative when there is current from $V_3$ to $V_1$ in FIG. 1, and to positive when there is current from $V_1$ to $V_3$. An updown counter is operated by using this voltage to to determine when the circuit is not generating such counter electromotive force (zero-cross timing). The efficiency of the circuit will be the maximum at the zero-cross timing. FIG. 2 (*f*) shows the above. In a state where the switch 16 is at ON state (the period where +Rtime is positive), the signal $V_2$ is generated when the switch 16 is turned off, there there is a counter electromotive force effect (* section in FIG. 2 (*f*)).

The capacity $C_X$ of the capacitance 18 is so determined as to be just at the drive voltage at the zero-cross timing. If the value of $C_X$ is too high, the drive waveform may cause overshoot. If it is insufficient, insufficient portion is supplied from the first drive 22. Either cases take time.

If the value $L_X$ of the inductance 14 is made higher, EMI is reduced because the resonance frequency can be lowered, and it becomes easy to increase the efficiency of the circuit, but it takes much time in the common inversion. If the value $L_X$ is made lower, it takes less time in the common inversion, but the loss in the circuit is increased because high current instantaneously flows, and noise tends to increase. The loss of the circuit becomes worse as the resonance frequency becomes higher. The circuit becomes inoperable at a frequency higher than the critical frequency of $2\pi C_P \cdot R_P \cdot f_o = 1$ where the resistance of LCD panel is $R_P$, and the critical frequency is $f_o$.

Although the efficiency of the circuit deteriorates with higher resistance $R_P$ of the liquid crystal, and the resonance condition may not be satisfied, this does not generally happen. The reasons are as follows:

The resonance condition for the circuit shown in FIG. 1 is:

$$L_X/R_P > C_P \cdot R_p$$

thus, $$R_P^2 \cdot C_P < L_X \quad (1)$$

If the value of $R_P$ exceeds the condition, no resonance occurs, and simple attenuation waveform is provided. Because the resonance completes at half cycle of the resonance circuit, and the time is required to be shorter than the horizontal scan period, the following relationship is obtained:

$$\pi \cdot \sqrt{Cp \cdot Lx} \cdot fs < 1$$

where $f_s$ is the horizontal scanning frequency. When the formula (1) is substituted for the above formula. the following has to be established:

$$\pi C_P \cdot R_P \cdot f_s < 1 \quad (2)$$

Because the cut-off frequency determined by the time constant of the LCD panel must be higher than the horizontal scanning frequency, it is necessary that the following formula should be originally established:

$$2\pi C_P \cdot R_P \cdot f_s < 1 \quad (3)$$

It is seen from the formula (3) that the formula (2) is always established. That is, the present invention can be applied to any panel in which the common inversion is performed. In addition, because of the difference in the constants in the formulae (2) and (3), even a frequency which cannot drive a typical panel with common inversion can drive by using a drive circuit containing the resonance circuit.

The above-mentioned embodiment of the present invention may be modified in a number of ways. For example, although the analog switch 16 is provided at the side of the capacitance 18, it may be provided at the side of the common electrode. In addition, it may be possible to eliminate the second driver, and to provide only the capacitance 18. In this case, however, because the changes driven by the first driver is increased, the speed and the power consumption are not as good as in the embodiment of FIG. 1. Furthermore, if the two potentials of the common electrode which change at the common inversion are symmetrical relative to the ground (that is, −2.5V and +2.5V), it may be possible to eliminate the capacitance 18 and the second driver, and to connect the analog switch 16 to ground (FIG. 3). In this case, because desired potential (for example, −2.5V and +2.5V) cannot be reached even if the resonance circuit is operated, the charge supplied by the first driver increases. This may be further modified. If two potentials of the common electrode which change at the common inversion are +5V and 0V as in the above-mentioned embodiment, a power supply for an intermediate potential +2.5V between them is connected to the analog switch 16 as in the above. If the power supply is +2.5V in potential, and has very high capacitance and high impedance, it can hold the energy as in the above, thereby being able to reduce power consumption during resonance. While the supply voltage may be a voltage between two voltages but not at the intermediate potential, the charge supplied by the first driver increases and the the reduction of power consumption is degraded.

As described, it has been possible to provide a device which can change the voltage of the common electrode of the LCD panel to a desired voltage with less current.

It has been possible to provide a device with less power consumption by recovering and reutilizing the energy stored in the common electrode.

In addition, when an additional capacitance such as the capacitance 18 is provided, Q of the entire circuit can be increased regardless of Q of the LCD panel by selecting a capacitance with high Q so that the recovery efficiency of energy can be improved.

What is claimed is:

1. A liquid crystal display panel having x and y drivers for driving one end of individual pixel capacitances of the display panel with a single polarity voltage, characterized by:

a driver circuit for a common electrode connected to the opposite ends of the pixel capacitances in the liquid crystal display panel for the periodic reversal of liquid crystal voltages comprising:

a first driver for driving a capacitive load of said common electrode in said liquid crystal display panel to provide a predetermined voltage every horizontal scan period;

a resonance circuit including an inductance and a charge hold capacitance having a capacity bigger than the capacitive load of said common electrode;

switching apparatus that switches into operation said resonance circuit for a predetermined period when the voltage of said common electrode is changed wherein one end of said inductance is connected to said common electrode, and the other end is connected to said switching apparatus; and a second driver for adding charge to said charge hold capacitance to compensate for loses in the driver circuit.

2. The driver circuit for a common electrode in a liquid crystal display panel according to claim 1, wherein said second driver operates while said first driver is operating.

3. The driver circuit for a common electrode in a liquid crystal display panel according to claim 1, wherein the duration in which said resonance circuit operates is half of the cycle of said resonance circuit.

4. A liquid crystal display panel having x and y drivers for driving one end of individual pixel capacitances of the display panel with a single polarity voltage characterized by:

a driver circuit for a common electrode connected to opposite ends of the pixel capacitances in the liquid crystal display panel for the periodic reversal of voltage polarity on liquid crystal material of the display panel comprising:

a driver for driving a capacitive load of said common electrode to provide two predetermined voltages of opposite polarity to the ground voltages to the liquid crystal material every horizontal scan period;

an inductance in a resonance circuit with said capacitive load; and switch means for switching on said resonance circuit for a predetermined period when the voltage of said common electrode is changed, wherein one end of said inductance is connected to the ground through said switch means.

5. The driver circuit for a common electrode in a liquid crystal display panel according to claim 4, wherein the timing to turn off said switch means is at the time when the current flowing through said inductance becomes substantially zero.

6. A liquid crystal display device comprising:

a liquid crystal display panel with x and y drivers for applying a voltage to one end of individual pixel capacitances;

a driver circuit connected at a common terminal to the opposite end of the pixel capacitances for periodically charging and discharging an inherent capacitance at said common terminal to cause a phase reversal of the voltage applied to a liquid crystal material of the liquid crystal panel, said driver circuit including:

driver means for supplying charge from a source to the inherent capacitance; and a resonant circuit for reducing power consumed from the source by temporarily storing charge discharged from the inherent capacitance when the inherent capacitance is discharged and thereafter returning the charge to the inherent capacitance when the inherent capacitance is again charged wherein said resonant circuit includes a capacitance storage means with a capacity larger than that of the inherent capacitance for the temporary storage of the discharged charge and an inductor connected in series between the inherent capacity and the capacitance storage means during the charging and discharging of the inherent capacitance; and wherein said resonant circuit also includes a switch interposed between the inductor and the capacitance storage means for making and breaking the series connection once every horizontal scan period of the liquid crystal display device.

7. The liquid crystal display device of claim 6 wherein said driver means includes a path providing charge to the capacitance storage means.

8. In a liquid crystal display device with a liquid crystal display panel having x and y drivers for applying a single polarity voltage to one end of individual pixel capacitances, the method of reversing the polarity of voltage applied to liquid crystal material of the display panel by periodically charging and discharging the inherent capacitance of the liquid crystal display device at a common point attached to the other ends of each of the pixel capacitances through a resonant circuit, storing charge discharged from the inherent capacitance in a storage capacitance of the resonant circuit and thereafter returning the charge to the inherent capacitance when the inherent capacitance is again charged; and providing charge lost in the transfer through the resonant circuit to maintain the inherent capacitance properly and quickly charged whereby power consumed by the charging and discharging is reduced.

9. A liquid crystal display panel having x and y drivers for driving one end of individual pixel capacitances of the display panel with a single polarity voltage, characterized by:

a driver circuit for a common electrode connected to the opposite ends of the pixel capacitances in the liquid crystal display panel for the periodic reversal of liquid crystal voltages comprising:

a first driver for driving a capacitive load of said common electrode in said liquid crystal display panel to provide a predetermined voltage every horizontal scan period;

a resonance circuit including an inductance and a charge hold capacitance having a capacity bigger than the capacitive load of said common electrode;

switching apparatus that switches into operation said resonance circuit for a predetermined period when the voltage of said common electrode is changed wherein one end of said inductance is connected to said charge hold capacitance, and the other end is connected to said switching apparatus; and a second driver for adding charge to said charge hold capacitance to compensate for loses in the driver circuit.

* * * * *